United States Patent [19]

Mowbray

[11] 4,032,772

[45] June 28, 1977

[54] LIGHT ATTACHMENT FOR A COMPACT

[75] Inventor: John A. Mowbray, Satellite Beach, Fla.

[73] Assignee: Agostino Orlando, Taylor, Mich.

[22] Filed: July 12, 1976

[21] Appl. No.: 704,306

[52] U.S. Cl. ..... 240/6.45 R; 240/4.2; 240/52.5

[51] Int. Cl.[2] ..... A45C 15/06

[58] Field of Search ..... 240/6.45 R, 6.45 P, 240/52.5, 4.2

[56] References Cited

UNITED STATES PATENTS

| | | | |
|---|---|---|---|
| 3,163,364 | 12/1964 | Ritter et al. | 240/6.45 R |
| 3,619,596 | 11/1971 | Jackson | 240/6.45 R |

*Primary Examiner*—John Gonzales

*Attorney, Agent, or Firm*—Barnes, Kisselle, Raisch & Choate

[57] ABSTRACT

A light attachment for a compact which includes a spring arm on which a small flashlight is mounted. The spring arm is adapted to be flexed by the user's finger while the compact is held in the palm of the hand to depress a switch button on the flashlight and thereby energize the light. The flashlight is readily adjustable to project a beam of light toward the user's face.

14 Claims, 4 Drawing Figures

LIGHT ATTACHMENT FOR A COMPACT

This invention relates to a light attachment for a compact. Frequently women find it necessary to apply cosmetics to their face when they are in dimly lighted surroundings. If the woman's face is not properly illuminated, then the mirror on the inside of the cover of the compact is of little use.

It is an object of this invention to provide a light attachment for a compact which enables a woman to apply make-up to her face in dimly lighted surroundings.

It is a further object of the invention to provide a light attachment adapted to be movably mounted on a compact and designed so that when the attachment is fixedly mounted on the compact the light thereon can be readily manipulated to direct a beam of light toward the user's face from and in various directions, thus eliminating the necessity of holding the compact in a predetermined position relative to the user's face.

Other features and objects of the present invention will become apparent from the following description and accompanying drawings, in which.

Figure 1:
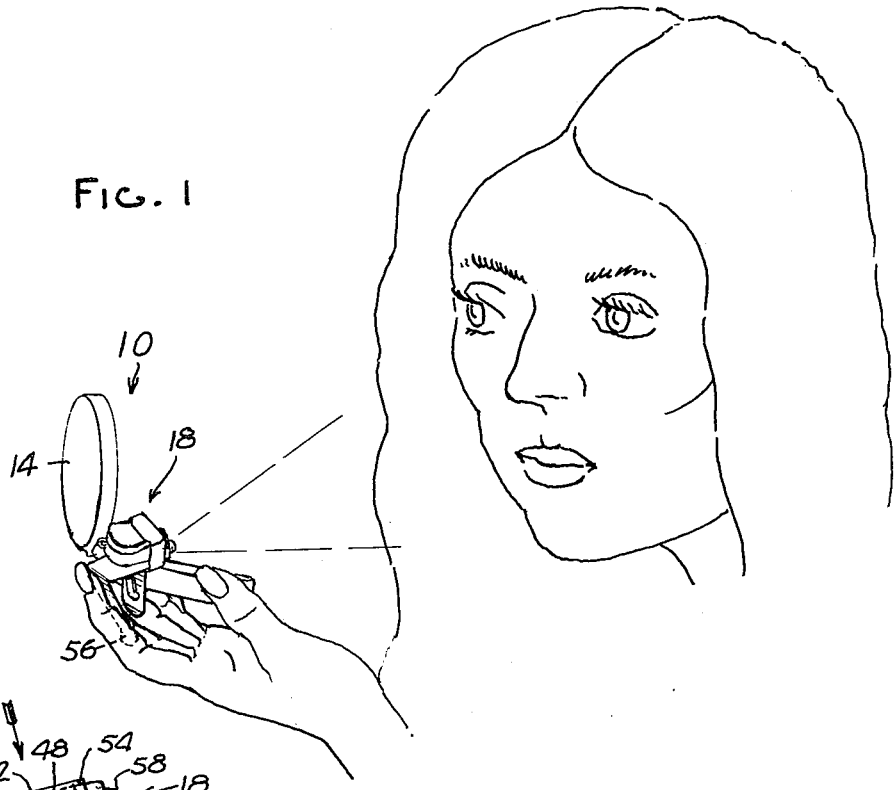
FIG. 1 is a perspective view of a person using a compact provided with the light attachment of this invention.
Figure 2:
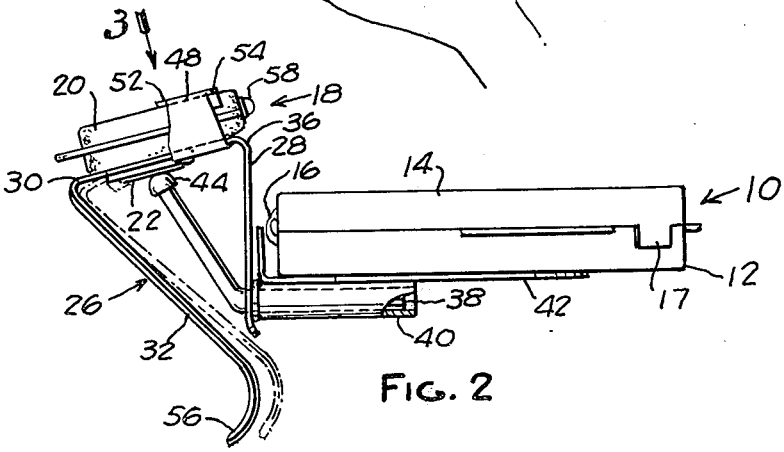
FIG. 2 is a side elevational view of the compact with the light attachment mounted thereon.

In the drawings, the compact is generally designated 10. The compact has a body portion 12 on which a cover 14 is hinged, as at 16. On the inner face of cover 14 there is mounted a mirror (not illustrated). The usual finger grip tab 17 is formed on the edge of cover 14 for facilitating opening of the compact.

The light attachment of the present invention is generally designated 18 and includes a small battery-operated flashlight 20. Flashlight 20 is of the type having a depressible circular switch button 22 on the underside thereof. The flat bottom face of flashlight 20 is formed with a circular rib 24 which extends around switch button 22. The light attachment of the present invention includes a generally triangularly shaped arm 26 on which flashlight 20 is mounted. Arm 26 is preferably formed of a resiliently flexible sheet metal strip and includes three sections; namely, 28, 30 and 32. While the sections 28, 30, 32 may be fairly stiff (section 32 being reinforced by a rib 34), the bend 36 between sections 28 and 30 is resiliently flexible.

Figure 4:
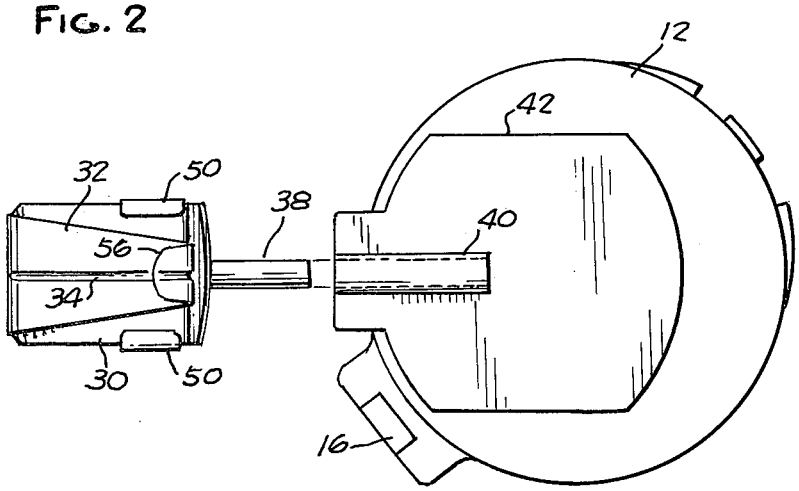
FIG. 4 is a bottom plan view of the compact with the light attachment partially removed therefrom.

At the lower end of section 28 there is fixedly mounted thereon a short tube 38 which extends generally perpendicularly to the plane of section 28. Tube 38 is adapted to be telescoped into a cylindrical sleeve 40 fixedly mounted, such as by soldering or the like, to the bottom side of a flat support plate 42. Support plate 42 is arranged to be mounted on the flat bottom face of compact 12 by any suitable means: for example, the top face of plate 42 may be coated with a pressure sensitive adhesive protected by a paper strip adapted to be pulled therefrom when it is desired to adhere plate 42 to the bottom face of the compact. Plate 42 is preferably mounted on the compact so that sleeve 40 is adjacent, but offset from, hinges 16 (FIG. 4). Tube 38 extends through section 28 of arm 26 and is inclined upwardly therefrom so that its upper end 44 terminates directly adjacent the switch button 22 on the underside of flashlight 20.

Figure 3:
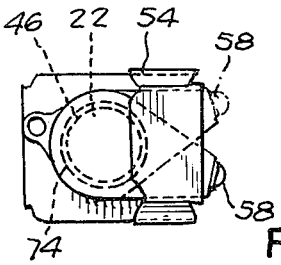
FIG. 3 is a view taken in the direction of the arrow 3 in FIG. 2.

The section 30 of arm 26, by reason of its resilient connection at the bend 36 with section 28, comprises a spring leg. Leg 30 is formed with a central aperture 46 sized to snugly receive the circular rib 24 on the underside of the flashlight. Flashlight 20 is retained in a seated condition on leg 30 by means of an inverted, generally U-shaped clip 48. Clip 48 is slideably mounted on leg 30 by inwardly turned tabs 50 at the lower ends of its legs which engage the underside of leg 30. The top bite section 52 of clip 48 which engages the flat upper face of the flashlight has downwardly struck tabs 54 at opposite sides thereof. As is best seen in FIG. 3, the forward end of flashlight 20 is tapered and has a width substantially less than the spacing between tabs 54. Thus, although clip 48 retains the flashlight in a seated condition within opening 46 on leg 30, nevertheless the flashlight can be rotatably adjusted as shown in FIG. 3 within the extent permitted by the abutment of tabs 54 with the opposite sides of the flashlight body adjacent the forward end thereof.

The third section 32 of arm 26 is formed with a hook portion 56 at the lower free end thereof. As is shown in FIG. 1, hook 56 is adapted to be engaged by the user's index finger when the compact is held in the palm of the user's hand. In this position hook 56 can be pressed or deflected toward the body of the compact so that leg 30 swings downwardly about the bend 36. This action causes the upper end 44 of tube 38 to engage and depress the switch button 22 and thereby illuminate the bulb 58 of the flashlight.

From the above description it is apparent that a flashlight 20 can be adjusted as desired to project a beam of light on the user's face so that the image thereof on the compact mirror will be properly illuminated. The adjustment of the flashlight is dual in nature. It can be rotated within the opening 46 in the manner illustrated in FIG. 3 and it can also be revolved in a vertical plane about the axis of tube 38. Arm 26 can be removed from the compact by simply withdrawing tube 38 from within sleeve 40. Likewise, if it is desired to remove the flashlight from the attachment, the leg 30 can be flexed downwardly sufficiently to disengage the rib 24 from aperture 46 and thus permit the flashlight to be withdrawn from within clip 48.

I claim:

1. A light attachment for a compact comprising a support adapted to be secured to the body portion of a compact of the type having a hinged cover with a mirror on the inner face thereof, an arm on said support, a flashlight having a generally flat mounting face, said flashlight having a depressible switch button on said face which when depressed energizes the light, said arm having a resiliently flexible leg thereon, said leg having an aperture therein, said flashlight being mounted on said leg with the switch button registering with said aperture and a rigid switch actuator on said arm projecting toward and terminating directly adjacent said switch button whereby when said leg is flexed toward said actuator said switch button is depressed to energize the light.

2. A light attachment as called for in claim 1 wherein said support comprises a generally flat plate adapted to be secured to the bottom face of the compact body.

3. A light attachment as called for in claim 1 wherein said leg has a hooked free end portion adapted to be engaged by the user's finger to flex the arm when the compact is held in the palm of the hand.

4. A light attachment as called for in claim 1 wherein said flashlight is mounted on said arm for rotative adjustment.

5. A light attachment as called for in claim 1 wherein said arm is mounted on said support for rotative adjustment.

6. A light attachment as called for in claim 1 wherein said arm is mounted on said support for rotative adjustment about an axis generally parallel to the plane of said compact and wherein said flashlight is mounted on said arm for rotative adjustment in a plane inclined to the plane of the compact.

7. A light attachment as called for in claim 1 wherein said flashlight is seated on the upper face of the arm and including means mounted on said leg and extending over the flashlight to retain the flashlight on said leg.

8. A light attachment as called for in claim 7 wherein said aperture is circular and said mounting face of the flashlight is formed with a circular rib seated in said aperture to permit rotative adjustment thereof.

9. A light attachment as called for in claim 8 wherein said last-mentioned means comprises an inverted, generally U-shaped clip member on said arm.

10. A light attachment as called for in claim 9 wherein said clip member is slideably mounted on said leg.

11. A light attachment as called for in claim 9 wherein the legs of said U-shaped clip member are spaced laterally from the body of the flashlight to limit the extent of rotative adjustment thereof.

12. A light attachment as called for in claim 1 wherein said support comprises a flat plate adapted to be adhesively secured to the bottom face of the compact body and including a tubular sleeve mounted on said plate and a stud on said arm telescopically engaging said sleeve.

13. A light attachment as called for in claim 2 wherein said arm has at least three sections; namely, a first section extending upwardly from said plate, a second section extending upwardly from the upper end of the first section in a direction away from said plate, and a third section extending from the outer end of the second section, said second section comprising a spring leg having a resiliently flexible connection with the upper end of the first leg.

14. A light attachment as called for in claim 13 wherein said third leg extends downwardly from said second leg and is formed with a hooked portion at the lower end thereof.

* * * * *